US005585811A

United States Patent [19]

Jetzer

[11] Patent Number: 5,585,811

[45] Date of Patent: Dec. 17, 1996

[54] ANTENNA DEVICE FOR ELECTRONIC PRODUCT ANTI-THEFT SYSTEMS

[75] Inventor: Ernst Jetzer, Moerigen, Switzerland

[73] Assignee: Actron Enwicklungs AG, Rotkreuz, Switzerland

[21] Appl. No.: 258,109

[22] Filed: Jun. 10, 1994

[30] Foreign Application Priority Data

Jun. 11, 1993 [CH] Switzerland ..... 1751/93

[51] Int. Cl.[6] ..... H01Q 7/04

[52] U.S. Cl. ..... 343/867; 343/866; 343/742; 340/572

[58] Field of Search ..... 343/867, 866, 343/872, 873, 741, 742; 340/572; H01Q 7/04; G08B 13/22, 13/24

[56] References Cited

U.S. PATENT DOCUMENTS 4,872,018 10/1989 Feltz et al. ..... 343/867

5,239,284 8/1993 Hara et al. ..... 340/572

FOREIGN PATENT DOCUMENTS

0352513A2 1/1990 European Pat. Off. .

0428384A2 5/1991 European Pat. Off. .

*Primary Examiner*—Hoanganh T. Le

*Attorney, Agent, or Firm*—Finnegan, Henderson, Farabow, Garrett & Dunner, L.L.P.

[57] ABSTRACT

The antenna device has an antenna wire (1), a screening plate (2) and a casing receiving the antenna wire (1) and the screening plate. (2) and which is assembled from a front part (3) and a rear part (4). The two casing parts (3,4) together with the screening plate (2) form a sandwich structure on parts of their surface (sandwich surfaces (5,6,7)). The antenna wire (1) is positioned in a angle V-shaped portion (8) of the front casing part (3).

10 Claims, 2 Drawing Sheets

ANTENNA DEVICE FOR ELECTRONIC PRODUCT ANTI-THEFT SYSTEMS

FIELD OF THE INVENTION

The present invention relates to an antenna device for electronic product anti-theft systems with an antenna wire, a screening plate and a casing receiving the antenna wire and the screening plate and which is assembled from a front part and a rear part.

BACKGROUND OF THE INVENTION

An antenna device of this type is e.g. known from WO91/17533. In supermarkets such devices are positioned in pairs on either side of the passageways between the cash registers and one of the two antennas serves as a transmitting antenna and the other as a receiving antenna. An electromagnetic alternating field emitted by the transmitting antenna can excite to resonate resonant circuits on tags, which are fitted to the products to be protected. The field change resulting from the presence of an excited resonant circuit can be detected by means of the receiving antenna and used for triggering a theft alarm.

Screens or shields are associated with the antennas, so as to produce surroundings which, with respect to the transmitting and receiving antennas, are very clearly defined and independent of the presence of electrically conductive parts in the cash registers. In the case of WO91/17533 they consist of a screening plate or a screening grid. The screens screen the antennas against unwanted signals, which are produced by electronic devices within the cash registers. The screens also ensure that an alarm is not triggered, if a product provided with the resonant circuit is correctly placed on the conventionally used conveyor belt and is moved on the latter on the back e.g. passed the transmitting antenna to the cash register.

However, such screens have a disadvantageous influence on the antenna characteristics. However, this influence decreases with increasing distance between the antenna wire and the screens. Due to the generally limited width of the passages between the cash registers, this distance cannot be made randomly large. WO91/17533 considers that a spacing of 4 cm is adequate. For the mechanical stabilization of the antenna wire in WO91/17533 a tube is provided, but it is also mentioned that the antenna, the screen and the associated transmitting and reception electronics can be integrated into a unit.

An antenna device for detecting magnetic strip tags or labels, with an antenna wire running in the form of several loops and a screening plate integrated into a casing is known from EP-A2-352,513. The casing is in this case longitudinally divided into a front and a rear casing part. The casing is very voluminous. The necessary stability is given to the overall arrangement by carrying and stiffening elements integrated into the casing. All the cavities in the casing are also foam-filled.

SUMMARY OF THE INVENTION

The objective of the invention is to provide, in the case of an antenna device of the aforementioned type wherein, the antenna or antenna wire, screen, casing and preferably also the transmitting and receiving electronics can be assembled to form a unit in such a way that in combination it in particular has the following advantageous characteristics:

a) good mechanical stability in the case of simple construction, b) inexpensive manufacture, c) ease of assembly, d) limited thickness, e) considerable distance between the antenna wire and the screen, f) optically attractive appearance.

This problem is solved by an antenna device, in accordance with the present invention.

In that the two casing parts and the screening plate in part and namely preferably where this is possible form a sandwich structure, the antenna device according to the invention has a slender appearance. The sandwich structure also permits use of simple assembly fasteners, e.g. short screws. A rigid structure is obtained with respect to the front casing part as a result of a V-shaped portion for receiving the antenna wire. By positioning an antenna wire in the preferably acute angled bottom of the V-shaped portion, based on the overall thickness of the arrangement, the maximum possible spacing is obtained between the antenna wire and a screening plate. The total device thickness is approximately the same as antenna wire/screening plate spacing. The front and rear casing parts can be produced in simple, inexpensive manner by deep-drawing of plastic plates or by plastic injection moulding. The V-shaped, stiffening portion of the front casing part provided for the reception of the antenna wire is also advantageous in that it provides sloping faces between the antenna wire pairs, where deflections can occur e.g. due to impacts caused by shopping trolleys.

Advantageous and preferred further developments of the invention include the necessary transmitting and receiving electronics being integrated in simple manner into the casing. It is also conceivable for integration to take place in the same casing of an antenna wire and/or the associated electronics of a deactivating device. The antenna wire could be located in a V-shaped portion in the rear casing part. Finally, the screening plate and the rear casing part may be provided as an integral part.

BRIEF DESCRIPTION OF THE DRAWINGS

The invention is described in greater detail hereinafter relative to preferred embodiments and the attached drawings, wherein.

In the different drawing figures the same parts are given the same reference numerals throughout.

WAYS OF IMPLEMENTING THE INVENTION

Figure 1:
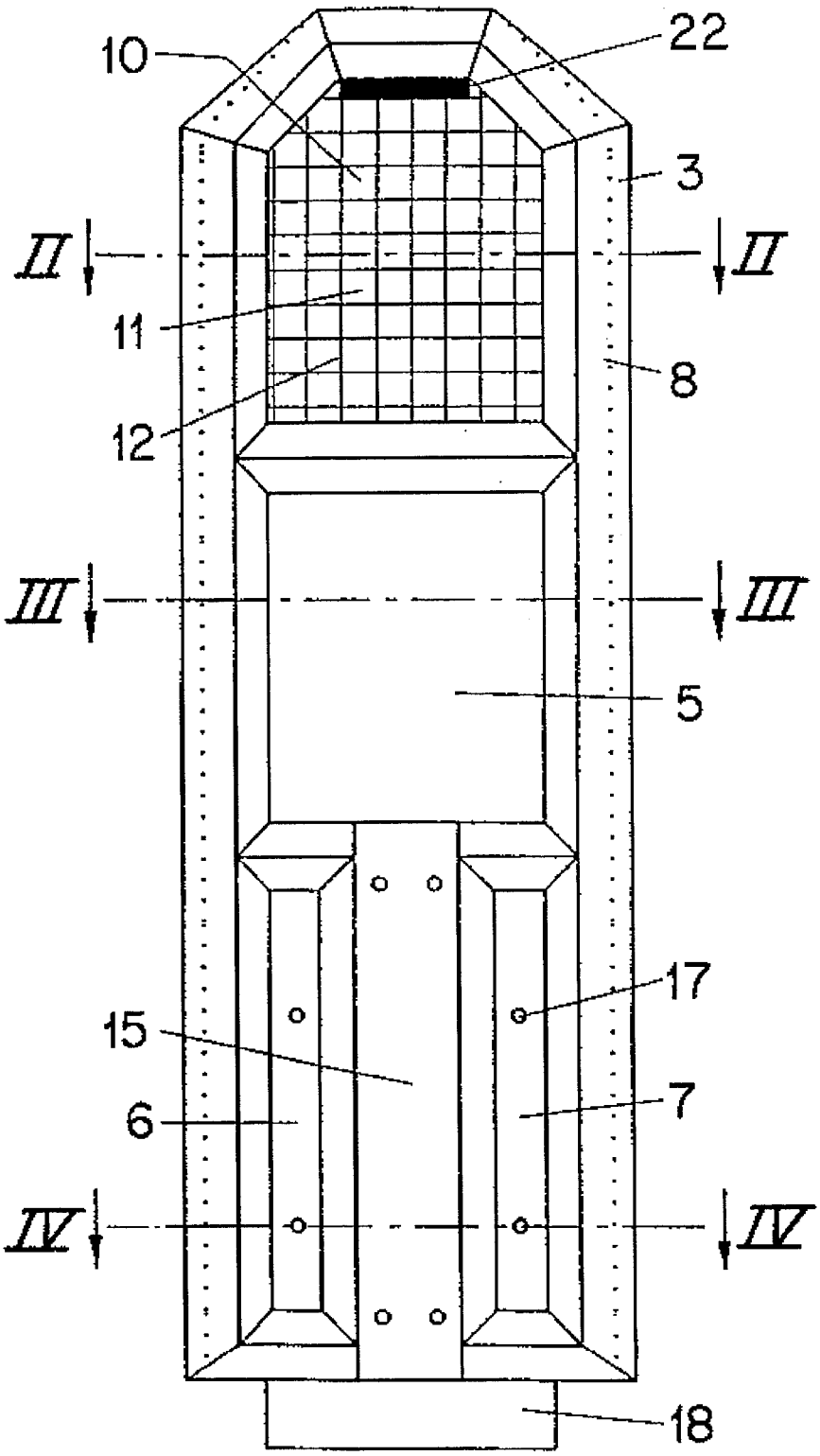
FIG. 1 is a front view of an antenna device according to the invention.
Figure 2:
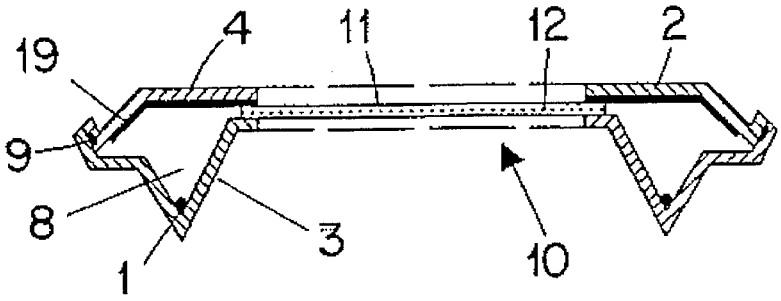
FIG. 2 is a cross-section along the line II—II through the upper part of the antenna device on line II—II of FIG. 1.
Figure 3:
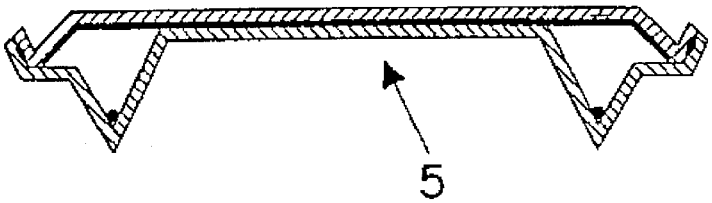
FIG. 3 is a cross-section along the line III—III through the central part of the antenna device on the line III—III of FIG. 1.
Figure 4:
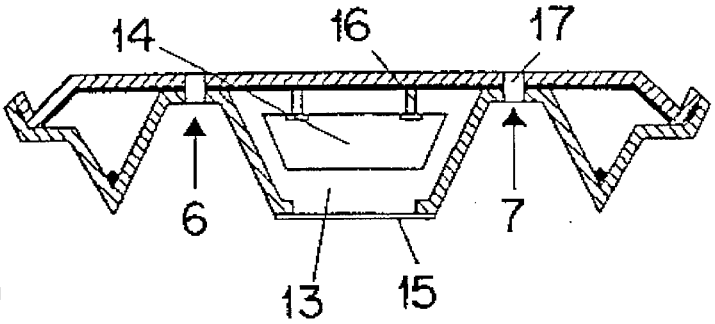
FIG. 4 is a cross-section along the line IV—IV through the lower part of the antenna device on the line IV—IV of FIG. 1.

The antenna device shown in the drawings includes a casing an antenna wire 1 and a screening plate 2, as seen in FIGS. 2–5. The casing is assembled from a front part 3 and a rear part 4. On portions of the surface designated 5, 6 and 7, the two casing parts 3 and 4 form, together with the screening plate 2, a sandwich structure. The antenna wire 1 is located in profile, in an approximately V-shaped portion 8 of the front casing part 3. Marginal portions of the two casing parts 3, 4 beyond the screening plate 2 are interconnected by means, such as an ultrasonic welding joint 9.

The antenna wire may comprise three superimposed loops. A window 10 is formed in corresponding recesses in the two casing parts 3, 4 and in the screening plate 2.

Preferably, in the window opening 10 is placed a transparent plastic disk 11 with an integrated network of electrically conductive wires 12, there being a partial marginal overlap of the network and the screening plate 2. It is possible to fit on the upper edge of the window opening 10 a lamp module 22. Within the antenna wire loop and between the sandwich surfaces 6 and 7, the front casing part 3 has a further portion, which leads to a cavity 13 for receiving a transmitting or receiving electronics 14. A front opening in said portion can be closed with a cover 15.

The screening plate 2 preferably carries the transmitting or receiving electronics fixed thereto by suitable means, such as screw thread bolts 16 welded to the screening plate.

To enable the overall device to be simply, e.g. laterally screw fitted to a cash register, in the lower sandwich surfaces can be provided holes 17 for the passage of fastening screws. The antenna device can also be provided with a base 18 and can be installed standing on the floor.

In order to improve the screening action the lateral edges 19 of the screening plate 2 can be bent forward at an obtuse angle.

Figure 5:
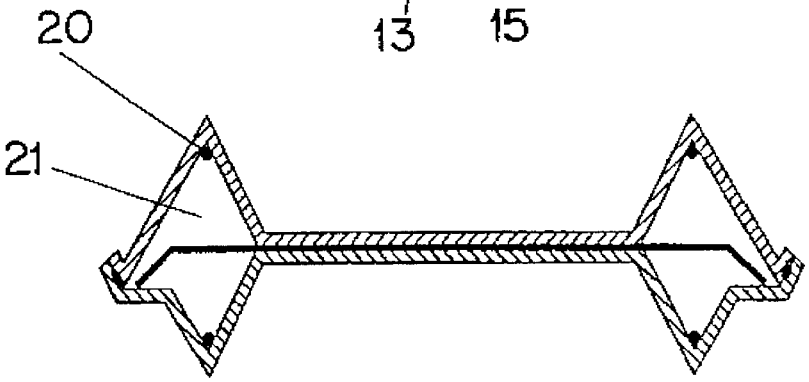
FIG. 5 is a cross-section through the central part of a further antenna device, into which a further antenna wire of a deactivating antenna is integrated.

FIG. 5 shows an embodiment of an antenna device, in which a further antenna wire 20, e.g. an antenna wire of a deactivating antenna, is integrated into the back of the casing. The antenna wire is placed, in the angle of an in profile, approximately V-shaped portion 21 of the rear casing part 4.

Figure 6:
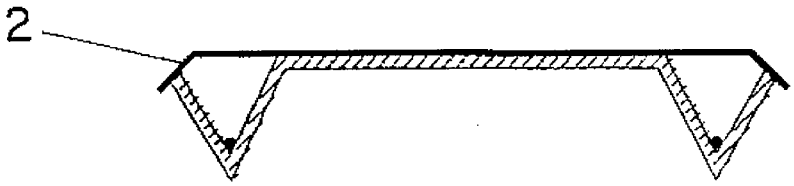
FIG. 6 is a cross-section through an antenna device, in which the screening plate directly forms the rear casing part.

Finally, FIG. 6 shows a cross-section through an antenna device, in which the screening plate 2 directly provides the rear casing part or is identical thereto.

I claim:

1. A device for use in electronic product anti-theft systems, comprising:

first and second casing parts joined together to provide a casing, at least the first casing part having an outwardly projecting, substantially V-shaped portion;

an antenna placed in a bottom of the V-shaped portion; and a screening plate disposed in the casing proximate the second casing part and in spaced relation to the antenna, wherein the first and second casing parts include opposed sections in contact with opposite sides of the screening plate to form a sandwich structure.

2. The device according to claim 1, wherein the antenna is in the form of at least one wire loop, and the V-shaped portion of the first casing part is in the form of a loop to receive the wire loop, the device further including a window in the casing formed by aligned openings in the first and second casing parts located within the loop form of the V-shaped portion of the first casing part.

3. The device according to claim 2, further comprising a transparent disk including an integrated network of electrically conductive wire, the transparent disk disposed in the casing in registry with the window and having a portion in lapped relation with the screening plate.

4. The device according to claim 1, wherein the antenna is in the form of a wire loop, and the V-shaped portion of the first casing part is in the form of a loop to receive the wire loop, the first casing part further including an outward projecting cavity at a location within the loop form of the V-shaped portion of the first casing part, the device further including transmitting/receiving electronics disposed in the cavity.

5. The device according to claim 4, further comprising retaining means fixing the transmitting/receiving electronics to the screening plate.

6. The device according to claim 1, further comprising means for securing the opposed sections of the first and second casing parts in juxtaposition to maintain the sandwich structure, thereby joining together the first and second casing parts to provide the casing.

7. The device according to any one of claims 1, 2, 3, 4, 5, or 6, wherein the screening plate includes lateral edge portions bent toward the first casing part at an obtuse angle, and the second casing part includes lateral edge portions formed in conformance with the bent lateral edge portions of the screening plate.

8. The device according to any one of claims 1, 2, 3, 4, 5, or 6, wherein the second casing part is formed having an outwardly projecting, substantially V-shaped portion, the device further comprising an additional antenna placed in a bottom of the V-shaped portion of the second casing part.

9. The device according to claim 8, wherein the screening plate includes lateral edge portions bent toward the first casing part at an obtuse angle, and the second casing part includes lateral edge portions formed in conformance with the bent lateral edge portions of the screening plate.

10. The antenna device defined in any one of claims 1, 2, 3, 4, or 5, wherein the second casing part and the screening plate are formed as an integral part joined to the first casing part.

* * * * *